United States Patent [19]

Hirose et al.

[11] Patent Number: 4,831,349

[45] Date of Patent: May 16, 1989

[54] SWITCHING DEVICE

[75] Inventors: Hisashi Hirose; Takanori Ohta; Shigeo Hara; Kazuo Iwata, all of Aichi, Japan

[73] Assignees: Toyota Jidosha Kabushiki Kaisha, Toyota; Kabushiki Kaisha Tokai Rika Denki Seisakusho, Aichi, both of Japan

[21] Appl. No.: 209,107

[22] Filed: Jun. 20, 1988

[30] Foreign Application Priority Data

Jun. 22, 1987 [JP] Japan ..... 62-094628[U]

[51] Int. Cl.[4] ..... H01H 45/02; H01H 3/20

[52] U.S. Cl. ..... 335/186; 335/164

[58] Field of Search ..... 335/186, 164, 165, 166, 335/129

[56] References Cited

U.S. PATENT DOCUMENTS 4,393,360 7/1983 Arakawa et al. ..... 335/164

4,584,546 4/1986 Hattori et al. ..... 335/186

*Primary Examiner*—H. Broome

*Attorney, Agent, or Firm*—Lackenbach Siegel Marzullo & Aronson

[57] ABSTRACT

A switching device suitable for use on vehicles as a window regulator switch or a sunroof regulator switch. The switching device comprises a solenoid unit including a yoke, a core and a coil, a first card attached to the core so as to be pressed against a contact for supplying current to the coil of the solenoid unit and to an external load such as a motor, to keep the contact closed while the core is attracted to the yoke, a second card disposed for movement in parallel to the direction of movement of the first card, a pivotally supported operating knob having an operating arm connected to the second card, and a returning mechanism for biasing the operating knob toward the neutral position to return the operating knob to the neutral position when released. When the operating knob is turned to a manual operating position the contact is closed temporarily and is opened when the operating knob is released. When the operating knob is turned to an automatic operating position, the second card is locked at an operating position to keep the contact closed even if the operating knob is released. The operating knob is returned to the neutral position by a returning mechanism when released.

1 Claim, 4 Drawing Sheets

SWITCHING DEVICE

BACKGROUND OF THE INVENTION

The present invention relates to a switching device suitable for use as switches for a vehicle, such as a window regulator switch and a sunroof switch.

A conventional switching device for such purposes is shown in FIGS. 5A and 5B. This switching device is operated by a knob 21. The knob 21 is operated to turn an operating arm 22 attached to the knob 21 on a shaft 23 to make the edge 24*a* of a card 24 connected to the operating arm 22 and fixed to the core shaft 25 of a solenoid 25 press the movable contact 26*a* of a transfer contact 26 or the movable contact 27*a* of a transfer contact 27. When the knob 21 is turned in a counterclockwise direction as viewed in FIG. 5A, the break contact 26*b* of the transfer contact 26 is opened and the make contact 26*c* of the same is closed.

As shown in FIG. 5B, the switching device is provided with a detent 28 essentially consisting of a pressing member 28*a* fitted in a bore formed in the operating arm 22, and a spring 28*b* provided in the bore of the operating arm 22 so as to press the pressing member 28*a* against a detent groove 28*c* to retain the knob 21 at a neutral position.

When the make contact 26*c* is closed, a current supplied from a power supply 31 flows via the make contact 26*c*, a diode 32 and a control circuit 33 through the coil 25*c* of the solenoid 25 and flows also via the make contact 26*c* and the break contact 27*b* through a load 34, such as a motor, as shown in FIG. 6. When the coil 25*c* is thus energized, an attraction is generated between the core 25*d* and yoke 25*b* of the solenoid 25. However, when the gap between the core 25*d* and the yoke 25*b* is large, and while the attraction is smaller than the sum of the resilience of the movable contact 26*a* and the retaining force of the detent 28, the core 25*d* returns to a neutral position to interrupt the supply of current to the load 34 and the coil 25*c* when the knob is 21 is released. Thus, such a knob operating mode makes the switching device function as a momentary switch manually operated by the knob.

When the knob 21 is operated further to reduce the gap between the yoke 25*b* and the core 25*d* after supplying a current to the coil 25*c* and the load 34, the attraction generated between the yoke 25*b* and the core 25*d* exceeds the sum of the resilience of the movable contact 25*a* and the retaining force of the detent 28, so that the core 25*d* is attracted to the yoke 25*b*. Consequently, the current is supplied continuously to the coil 25*c* and the load 34 after the knob 21 has been released. Thus, such a knob operating mode makes the switching device function as a latching switch. For example, when the control circuit 33 detects an overcurrent which flows when the load 34, such as a motor, is driven excessively, the control circuit 33 interrupts the current supplied to the coil 25*c* and unlatches the switching device automatically. It is also possible to unlatch the latched switching device by manually operating the knob 21 against the attraction of the solenoid.

In this conventional switching device, the knob is returned automatically to the neutral position when the knob is released in the manual operating mode, whereas the knob is not returned to the neutral position in the automatic operating mode until the automatic operating mode is accomplished even if the knob is released. Accordingly, when the switching device is mounted on a vehicle, in which the operating knob of the switching device is buried substantially in a control panel to avoid the erroneous operation of the knob or in view of the aesthetic appearance of the control panel, this conventional switching device is unsatisfactory in accessibility.

SUMMARY OF THE INVENTION

To solve the foregoing problems in the conventional switching device, the present invention provides a switching device comprising a solenoid unit including a yoke, a core and a coil capable of generating an attraction between the yoke and the core when energized, a first card attached to the core of the solenoid unit so as to be pressed against a contact for supplying current to the coil of the solenoid unit and to an external load, to keep the contact closed while the core is attracted to the yoke, a second card disposed for movement in parallel to the direction of movement of the first card attached to the core, a pivotally supported operating knob having an operating arm connected to the second card, and a returning mechanism for biasing the operating knob toward the neutral position, characterized in that the first card attached to the core of the solenoid unit is provided with a projection, the operating arm is provided with a pair of fingers for loosely receiving the projection of the first card connected to the core therebetween to operate the first card, and the returning mechanism is able to return the operating knob to the neutral position without moving the first card attached to the core while the coil of the solenoid unit is energized to maintain the contact in a fixed state.

BRIEF DESCRIPTION OF THE DRAWINGS

The above and other objects, features and advantages of the present invention will become apparent from the following description taken in conjunction with the accompanying drawings, in which.

DETAILED DESCRIPTION OF THE PREFERRED EMBODIMENT

A switching device, in a preferred embodiment, according to the present invention will be described hereinafter.

Figure 1:
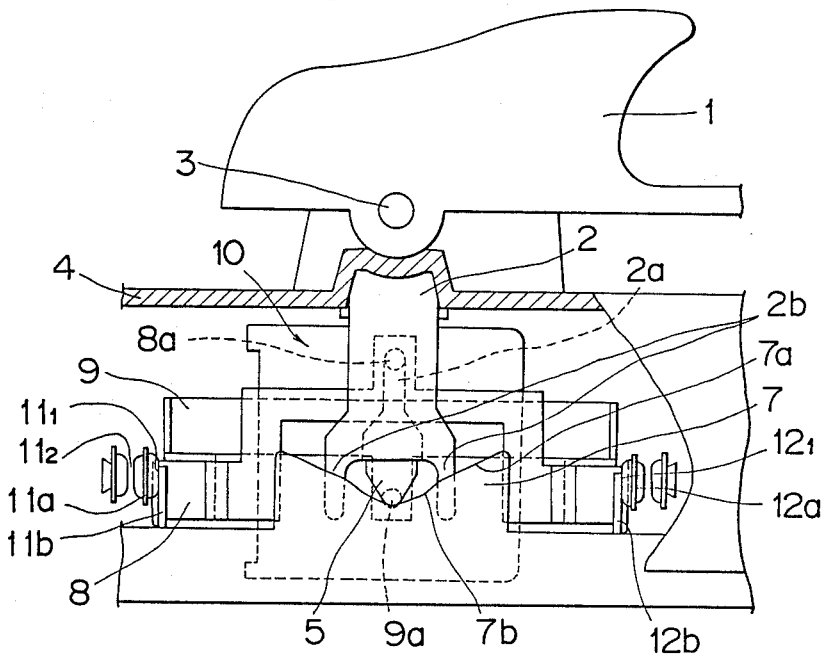
FIG. 1 is a partly cutaway sectional front elevation of a switching device embodying the present invention.
Figure 3:
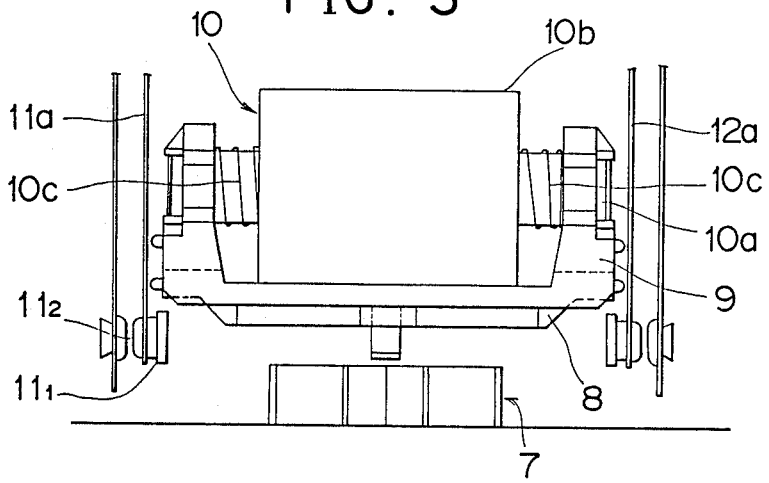
FIG. 3 is a plan view of the switching device of FIG. 1.
Figure 2:
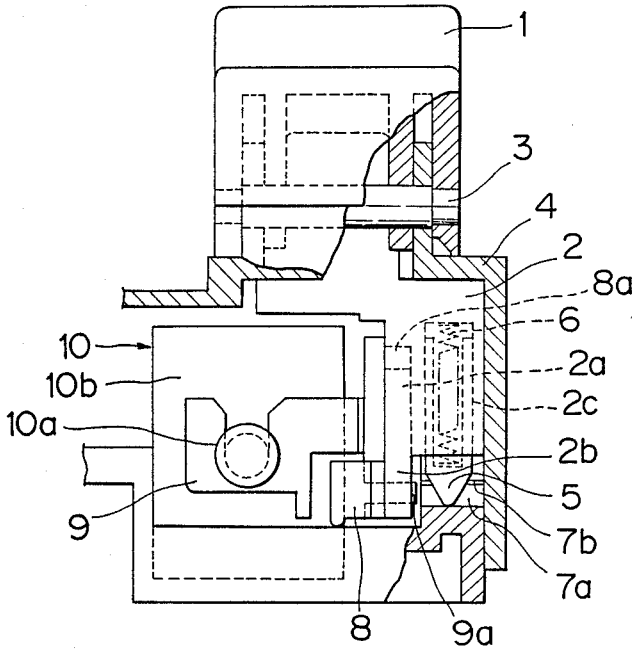
FIG. 2 is a partly cutaway sectional side elevation of the switching device of FIG. 1.

Referring to FIGS. 1 and 2, there are shown an operating knob 1, and operating arm 2 attached to the operating knob 1, pivotally supported by a shaft 3 on a case 4 together with the operating knob 1 and provided with a slot 2*a* for operating a manual card 8, and two fingers 2*b* for operating an automatic card 9, a pressing member 5 provided within a cylindrical bore 2*c* formed in the operating arm 2, a spring 6 provided within the cylindrical bore 2*c* so as to bias the pressing member 5 downward as viewed in FIGS. 1 and 2, a detent 7 having a V-shaped groove 7*a* against which the pressing member 5 is pressed and a step 7*b* formed in the groove 7*a* to indicate a manual position and an automatic position by clicks. The pressing member 5 and the detent 7 constitute a returning mechanism for biasing the operating knob 1 toward a neutral position shown in FIG. 1.

The manual card 8 is operated manually to press the respective movable contacts 11*a* and 12*a* of transfer contacts 11 and 12. A projection 8*a* projects from the center of the manual card 8, namely, a position corresponding to the operating arm 2, and is received in the slot 2*a* of the operating arm 2.

The automatic card 9 presses the respective movable contacts 11*a* and 12*a* of the transfer contacts 11 and 12 in an automatic operating mode. The automatic card 9 is provided with a projection 9*a* positioned in the middle of a space between the two fingers 2*b* of the operating arm 2.

A solenoid 10 generates an attraction on the sides of the two transfer contacts 11 and 12 to hold the respective make contacts of the transfer contacts 11 and 12 closed in the automatic operating mode. The solenoid 10 includes a core shaft 10*a* and a yoke 10*b*. The core shaft 10*a* is fixed to the automatic card 9. A spring 10*c* is provided between the core shaft 10*a* and the automatic card 9 to hold the core shaft 10*a* at a neutral position even if the solenoid 10 is energized, when the core shaft 10*a* is positioned at the neutral position.

Figure 6:
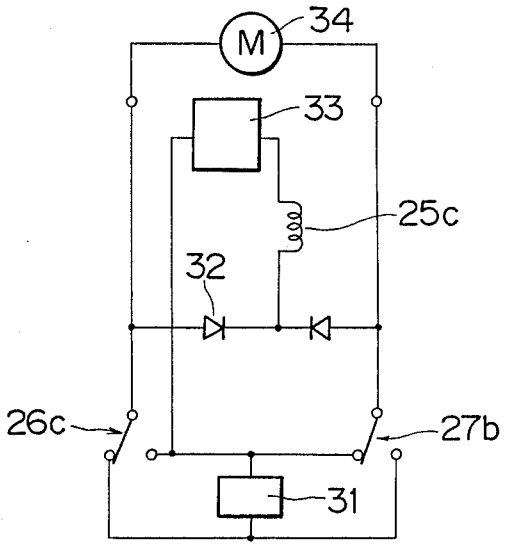
FIG. 6 is a circuit diagram of an exemplary circuit connected to the switching device of FIGS. 5A and 5B.

A circuit similar to that shown in FIG. 6 is connected to the transfer contacts 11 and 12 of the switching device. When the transfer contacts 11 and 12 are positioned respectively at neutral positions as shown in FIG. 1, a break contact $\mathbf{11}_1$ consisting of the movable contact 11*a* and the fixed contact 11*b* of the transfer contact 11, and a break contact $\mathbf{12}_1$ consisting of the movable contact 12*a* and the fixed contact 12*b* of the transfer contact 12 are closed.

When the operating knob 1 is turned clockwise as viewed in FIG. 1, the operating arm 2 pushes the projection 8*a* engaging the slot 2*a* of the operating arm 2 to shift the manual card 8 to the left. Then, the left end of the manual card 8 presses the movable contact 11*a* of the left transfer contact 11 to open the break contact $\mathbf{11}_1$, and then the make contact $\mathbf{11}_2$ of the left transfer contact 11 is closed before the tip of the pressing member 5 comes into abutment with the step 7*b* of the detent 7. Thus, a load, such as a motor, is driven and the solenoid 10 is energized. However, since the core shaft 10*a* of the solenoid 10 is positioned at the neutral position, the core shaft 10*a* is held at the neutral position by the resilience of the spring 10*c* provided between the core shaft 10*a* and the automatic card 9. When the operating knob 1 is released in this state, the manual card 8, the operating arm 2 and the operating knob 1 are returned respectively to the original positions by the pressure applied by the pressing member 5 to the inclined surface of the groove 7*a* of the detent 7 and the resilience of the movable contact 11*a*, and thereby the make contact 112 of the transfer contact 11 is opened to stop the motor. Thus, the operating knob 1 is released for manual operation when the pressing member 5 comes into abutment with the step 7*b* of the detent 7.

Figure 4A:
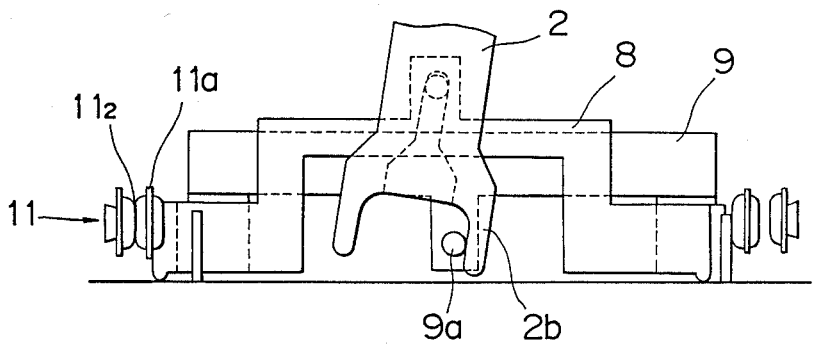
FIGS. 4A and 4B are illustrations of assistance in explaining the relation between an automatic card and fingers incorporated into the switching device of FIG. 1.

When the operating knob 1 is turned further beyond a position for manual operation, the pressing member 5 moves over the step 7*b* of the detent 7 and the finger 2*b* of the operating arm 2 pushes the projection 9*a* of the automatic card 9 to shift the automatic card 9 to the left as shown in FIG. 4A. At the same time, the manual card 8 is shifted to the left in the foregoing manner to close the make contact $\mathbf{11}_2$ of the transfer contact 11, and thereby the motor is driven and the solenoid 10 is energized.

When the automatic card 9 is thus shifted together with the core shaft 10*a* fixed to the automatic card 9, the core shaft 10*a* is attracted to the yoke 10*b* by an attraction generated by the solenoid 10 to hold the core shaft 10*a* and the automatic card 9 at the left position.

Figure 4B:
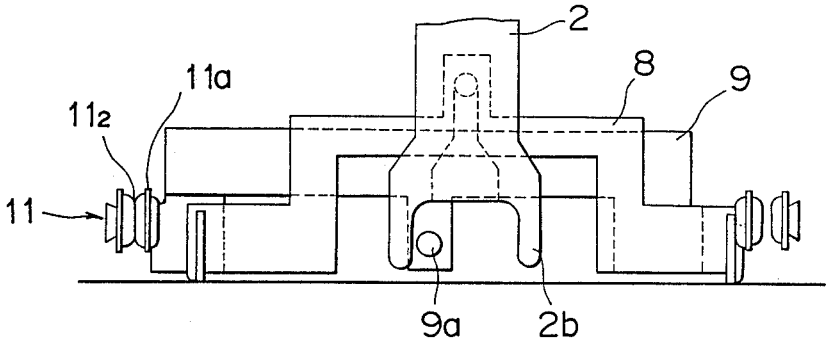
Figure 5A:
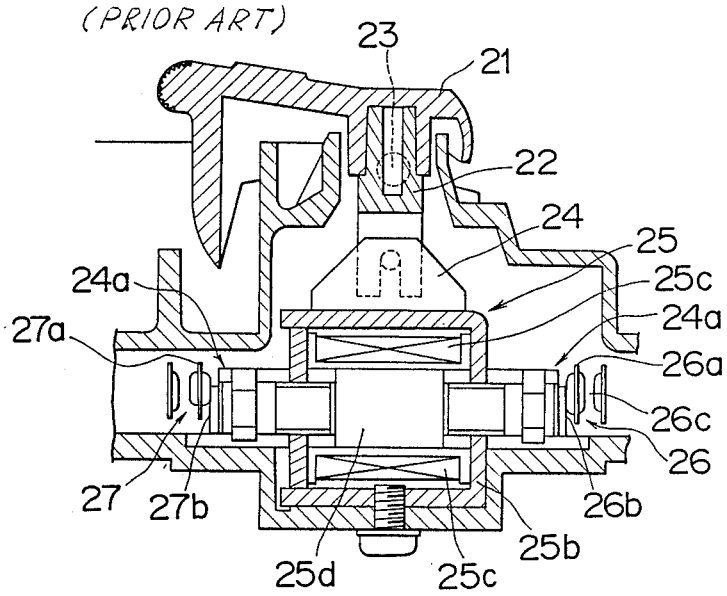
FIG. 5A (PRIOR ART)
FIGS. 5A and 5B are sectional views of a conventional switching device.
Figure 5B:
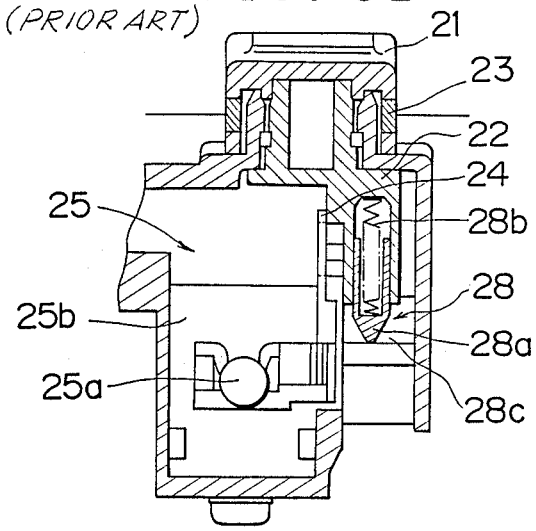
FIG. 5B (PRIOR ART)

On the other hand, since the two fingers 2*b* of the operating arm 2 are spaced apart from each other, the left finger 2*b* is separated from the projection 9*a* in a state where the automatic card 9 is held at the left position, and hence the manual card 8 is shifted to the right, the operating arm 2 is turned counterclockwise and the tip of the pressing member 5 is caused to drop into the bottom of the groove 7*a* of the detent 7 by the pressure applied to the inclined surface of the groove 7*a* of the detent 7 by the pressing member 5, when the operating knob is released after the automatic card 9 has been shifted to the left position. Consequently, the operating knob 1 is returned to the neutral position as shown in FIG. 4B. Since the automatic card 9 is held at the left position by the attraction of the solenoid 10 even if the operating knob 1 is released, the make contact $\mathbf{11}_2$ of the transfer contact 11 is held closed, and thereby the solenoid 10 is energized continuously and the motor is driven continuously for automatic operation. Holding the operating knob 1 at the neutral position during the automatic operation facilitate the operation of the operating knob 1 for cancelling the automatic operation.

When the operating knob 1 is thus returned to the neutral position, the finger 2*b* of the operating arm 2 is in contact with the projection 9*a* of the automatic card 9 as shown in FIG. 4B. Accordingly, the automatic card 9 is shifted to the right when the operating knob 1 is turned in the opposite direction, namely, in a counterclockwise direction. When the automatic card 9 is thus shifted to the right, the make contact $\mathbf{11}_2$ of the transfer contact 11 is opened to de-energize the solenoid 10. Consequently, the core shaft 10*a* and the automatic card 9 are returned respectively to the neutral positions to cancel the automatic operation by the resilience of the spring 10*c* provided between the core shaft 10*a* and the yoke 10*b*.

As apparent from the foregoing description, according to the present invention, the operating knob is returned to the neutral position when released during the automatic operation, the automatic operation can easily be cancelled.

Although the invention has been described in its preferred form with a certain degree of particularity, obviously many changes and variations are possible therein. It is therefore to be understood that the invention may be practiced otherwise than specifically described herein without departing from the scope and spirit thereof.

What is claimed is:

1. A switching device comprising:

a solenoid unit including a yoke, a core, and a coil capable of generating an attraction between the yoke and the core when energized;

a first card attached to the core of the solenoid unit so as to be pressed against a contact for supplying current to the coil of the solenoid unit and to an external load, to keep the contact closed while the core is attracted to the yoke;

a second card disposed for movement in parallel to the direction of movement of the first card attached to the core;

a pivotally supported operating knob having an operating arm connected to the second card; and a returning mechanism for biasing the operating knob toward the neutral position;

characterized in that the first card attached to the core of the solenoid unit is provided with a projection, the operating arm is provided with a pair of fingers for loosely receiving the projection of the first card connected to the core therebetween to operate the first card, and the returning mechanism is able to return the operating knob to the neutral position without moving the first card attached to the core while the coil of the solenoid unit is energized to maintain the contact in a fixed state.

* * * * *